US005112653A

United States Patent [19]

Damrau et al.

[11] Patent Number: 5,112,653

[45] Date of Patent: May 12, 1992

[54] METHOD OF AND APPARATUS FOR COATING HIGH SPEED TRAVELING WEBS

[75] Inventors: Wayne A. Damrau, Wisconsin Rapids; Michael A. Mayer, Stevens Point, both of Wis.

[73] Assignee: Consolidated Papers, Inc., Wisconsin Rapids, Wis.

[21] Appl. No.: 648,655

[22] Filed: Jan. 31, 1991

Related U.S. Application Data

[63] Continuation-in-part of Ser. No. 375,241, Jul. 3, 1989, abandoned.

[51] Int. Cl.[5] ..... B05D 3/12

[52] U.S. Cl. ..... 427/356; 118/410; 118/411; 118/413

[58] Field of Search ..... 118/126, 410, 411, 413; 427/356

[56] References Cited

U.S. PATENT DOCUMENTS

| | | | |
|---|---|---|---|
| 2,066,780 | 1/1937 | Holt | 118/414 X |
| 2,746,877 | 5/1956 | Matthes | 117/3.1 |
| 2,796,846 | 6/1957 | Trist | 118/410 |
| 2,949,382 | 8/1960 | Dickerman et al. | 117/65 |
| 2,970,564 | 2/1961 | Warner | 118/249 |
| 3,070,066 | 12/1962 | Faeber | 118/413 |
| 3,079,889 | 3/1963 | Jacobs et al. | 118/8 |
| 3,083,685 | 4/1963 | Colgan | 118/410 |
| 3,084,663 | 4/1963 | Warner | 118/118 |
| 3,113,884 | 12/1963 | Kohler | 117/37 |
| 3,192,895 | 7/1965 | Galer | 118/126 |
| 3,202,536 | 8/1965 | Brezinski | 117/83 |
| 3,273,535 | 7/1966 | Krikorian | 118/410 |
| 3,302,610 | 2/1967 | Mahoney | 118/126 |

(List continued on next page.)

FOREIGN PATENT DOCUMENTS

| | | | |
|---|---|---|---|
| 1942351 | 4/1971 | Fed. Rep. of Germany . | |
| 2359413 | 6/1975 | Fed. Rep. of Germany . | |
| 3620374 | 2/1987 | Fed. Rep. of Germany | 118/410 |
| 74130436 | 10/1974 | Sweden . | |
| 1266745 | 5/1972 | United Kingdom . | |

OTHER PUBLICATIONS

Tappi Conference Paper, 1978, "The Versatility of the Jet Fountain Blade Coater", S. C. Zink, The Black--Clawson Company.

*Pulp & Paper*, Apr. 29, 1963, "What's New in Coating", M. R. Castagne, pp. 51-58, esp. pp. 56-58.

*Paper Trade Journal*, Oct. 27, 1969, "Blade Coaters Newest, Fastest Growing Coating Process", G. L. Booth, pp. 58-62.

*Paper Trade Journal*, Feb. 22, 1971, "Improved Blade Coater Eliminates Skip Coating", p. 56.

(List continued on next page.)

*Primary Examiner*—Shrive Beck
*Assistant Examiner*—Alain Bashore
*Attorney, Agent, or Firm*—Juettner Pyle & Lloyd

[57] ABSTRACT

A method of and apparatus for applying coating liquid to a web of paper traveling over a web supporting surface at speeds of 3,000, 4,000 and more feet per minute to produce a coated web free of streaking and other imperfections comprises apparatus for and the sequential steps of distributing coating liquid in a turbulent state over the supported web through a limited application zone within a very short dwell time of the turbulent liquid on the web; subjecting the coating liquid on the supported web to an initial doctoring by means of a primary doctor blade biased under pressure against the coated web at the rear edge of the application zone to form on the web downstream from the zone a relatively quiescent layer of coating liquid having a wet film thickness sufficiently in excess of the final wet film thickness to accommodate a subsequent final wet film doctoring of the coating liquid on the web; and, a a location downstream and isolated from the application zone, subjecting the relatively quiescent layer of excess coating liquid on the supported web to a final docttoring by means of a final doctor blade biased under pressure against the coated web to remove the excess coating from the web and to level and smooth the coating retained on the web to final wet film thickness and smoothness.

31 Claims, 3 Drawing Sheets

U.S PATENT DOCUMENTS

| | | | |
|---|---|---|---|
| 3,348,526 | 10/1967 | Neubauer | 118/410 |
| 3,413,143 | 11/1968 | Cameron et al. | 117/120 |
| 3,418,970 | 12/1968 | Phelps et al. | 118/410 |
| 3,453,137 | 7/1969 | Penkala et al. | 117/102 |
| 3,484,279 | 12/1969 | Clark et al. | 117/111 |
| 3,486,482 | 12/1969 | Hunger | 118/603 |
| 3,518,964 | 7/1970 | Nagler | 118/65 |
| 3,521,602 | 7/1970 | Coghill | 118/14 |
| 3,930,464 | 1/1976 | Wallsten | 118/122 |
| 4,009,657 | 3/1977 | Bonanno et al. | 101/157 |
| 4,250,211 | 2/1981 | Damrau et al. | 427/356 |
| 4,263,870 | 4/1981 | Saito et al. | 118/414 X |
| 4,310,573 | 1/1982 | Damrau | 427/356 |
| 4,327,662 | 5/1982 | Damrau | 118/410 |
| 4,354,452 | 10/1982 | Patterson | 118/413 |
| 4,369,731 | 1/1983 | Damrau | 118/410 |
| 4,375,202 | 3/1983 | Miller | 118/119 X |
| 4,396,648 | 8/1983 | Holt et al. | 427/356 |
| 4,405,661 | 9/1983 | Alheid | 118/413 X |
| 4,407,227 | 10/1983 | Mauranen | 118/126 X |
| 4,426,412 | 1/1984 | Gebert et al. | 427/356 |
| 4,434,194 | 2/1984 | Gebert et al. | 427/356 |
| 4,440,105 | 4/1984 | Jeltema | 118/410 |
| 4,440,809 | 4/1984 | Vreeland | 427/356 |
| 4,452,833 | 6/1984 | Holt | 427/356 |
| 4,503,804 | 3/1985 | Damrau | 118/410 |
| 4,512,279 | 4/1985 | Damrau et al. | 118/411 |
| 4,534,309 | 8/1985 | Damrau et al. | 118/410 |
| 4,706,603 | 11/1987 | Wohlfeil | 118/410 |
| 4,757,782 | 7/1988 | Pullinen | 118/414 X |
| 4,780,336 | 10/1988 | Damrau | 427/356 |
| 4,791,879 | 12/1988 | Eklund et al. | 118/50 |
| 4,822,640 | 4/1989 | Tuhkanen et al. | 427/211 |
| 4,834,018 | 5/1989 | Sollinger et al. | 118/410 |
| 4,839,201 | 6/1989 | Rantanen et al. | 427/355 |
| 4,858,553 | 8/1989 | Westergard et al. | 118/126 |
| 4,869,933 | 9/1989 | Sollinger et al. | 427/356 |
| 4,873,939 | 10/1989 | Eskelinen | 118/410 |
| 4,911,097 | 3/1990 | Fundell | 118/410 |
| 4,964,364 | 10/1990 | Karna et al. | 118/410 |

OTHER PUBLICATIONS

*Tappi*, Feb. 1960, vol. 43, No. 2, "The Kohler Method of Coating", J. R. Gunning & J. B. Kohler, pp. 183–187.

*The Paper Industry*, Jun. 1959, "Kohler Coating Method", p. 232.

*Paper Trade Journal*, Jun. 8, 1959, "New Coater Installation", pp. 31–32.

*Pulp and Paper*, 2nd Ed., vol. III, James P. Casey, Interscience Publishers, pp. 1565–1566.

*Pulp and Paper Manufacture*, 2nd Ed., vol. II, 1969, R. G. MacDonald & J. N. Franklin, McGraw Hill Book Co., pp. 510–512.

Japanese Book *Manual for Paper Processing*, Kami--Kako-Binran, Jan. 15, 1974, pp. 129–132.

German Periodical *Walzen Und Glattschaberstreichanlagen*, Ing. Josef Geistbeck.

*Paper Trade Journal*, "Off-Machine Coater Leads Way . . .", Apr. 8, 1963, pp. 32–39.

Tappi 1986 Blade Coating Conference, G. L. Booth, "The Vari-Dwell Coater", 1986, pp. 109–113.

Tappi 1987 Coating Conference, G. L. Booth, "The Vari-Dwell-Time Blade Coater", 1987, pp. 141–149.

Paper Trade Journal, C. P. Klass, "Coater Head Change . . .", Mar. 13, 1967, pp. 52–53.

Paper Trade Journal, "Great Northern Is Now A Leader . . .", May 13, 1968, pp. 64–67.

Das Papier, von H. Waldvogel, "Neuentwicklungen bei Streichmaschinen", No. 7, 1972, pp. 332–338 at 334.

Pulp & Paper, May 1984, "New Short Dwell Coaters . . .", Michael J. Ducey, pp. 102–104.

"Operating and Maintenance Instructions for the Voith Smoothing Blade Coater", J. M. Voith GmbH, Heidenheim, Germany, Aug. 10, 1977.

METHOD OF AND APPARATUS FOR COATING HIGH SPEED TRAVELING WEBS

This is a continuation-in-part of copending application Ser. No. 07/375,241 filed on 7/3/89 now abandoned.

1. Technical Field

This invention relates to the technical field of applying a liquid coating composition to a moving web of paper, and more particularly to a coating apparatus and method involving new and improved applications of apparatus of the inverted trailing blade type. The invention is principally concerned with the application of heavier weight coatings, e.g., 5½ and more pounds per side per ream, to paper webs traveling at ultra-high speeds of 3,000, 4,000 and more feet per minute.

2. Background Art

U.S. Pat. No. 4,250,211 discloses a novel inverted blade type of paper coating method and apparatus that has come to be known as the "short dwell time application" or "SDTA" method and apparatus. The SDTA coater has essentially revolutionized the paper coating art.

The present invention provides a new and improved coating apparatus and method which utilizes, in a specific non-conventional interrelationship, modifications of and improvements upon SDTA and other web coating technologies.

A conventional coater of the trailing blade type includes means for applying a liquid coating composition to a moving web of paper, usually while the web is supported and carried by a resilient backing roll, together with a doctor blade located on the trailing side of the applicator and bearing under pressure against the roll supported coated web to level the applied coating. In general, an excess of coating material is applied to the web, and the trailing blade then meters or removes the excess while uniformly spreading the retained coating onto the web surface.

A first generation of blade coating apparatus, known as the "pond" or "puddle" coater, is comprised essentially of a blade angled downwardly toward and contacting the backing roll on the downwardly moving, incoming side of the roll and forming therewith a reservoir for coating material. The web is moved on the backing roll continuously through the reservoir and the "pond" or "puddle" of coating material therein, whereupon the exposed surface of the web picks up coating material which is struck off and leveled to the desired final thickness or coat weight as a consequence of passage of the web through the nip defined between the blade and the backing roll. Examples of this type of coater are shown in *Pulp & Paper*, Apr. 29, 1963, pp. 56-58, *Paper Trade Journal*, Oct. 27, 1969, pp. 58-62 and *Paper Trade Journal*, Feb. 22, 1971, p. 56.

A variant on the pond type coater, publicized as the Kohler Coater, eliminates the backing roll, disposes the pond or puddle in the horizontal plane, moves the web across the surface of the pond, and utilizes a variable pressure air knife to press the paper web against the blade at the web outlet end of the pond. The Kohler Coater, which is not known to have gained commercial acceptance, is disclosed in Kohler patent 3,113,884, Colgan patent 3,083,685, and articles appearing in the June 1959 issue of *The Paper Industry*, p. 232; the June 8, 1959 issue of *Paper Trade Journal*, pp. 31-32; the February 1960 issue of *Tappi*, pp. 183-187; *Pulp and Paper*, Second Edition, Vol. III, Interscience Publishers, pp. 1565-1566; and *Pulp and Paper Manufacture*, Second Edition, Vol. II, 1969, McGraw Hill Book Company, pp. 510-511.

A second generation of blade coating apparatus is comprised of a dip roll applicator, which usually bears against the roll supported web at or adjacent the bottom dead center position of the roll, and a blade spaced downstream from the dip roll and converging toward and contacting the roll supported web, usually on the upwardly moving, outgoing side of the roll. Since this results in the blade converging upwardly into engagement with the roll supported web, the blade is known as an inverted trailing blade. As the web moves with the backing roll, the dip roll is rotated through a reservoir of coating liquid and picks up and transfers to the web an excess of coating liquid. The web then travels to the inverted blade where the excess coating liquid is removed from the web and the retained coating is leveled to the desired final coat weight thickness. Examples of the dip roll applicator with inverted blade (known by the acronym "drib") are disclosed in Rush patent 2,746,877, Dickerman et al. patent 2,949,382, Brezinski patent 3,202,536, the Apr. 29, 1963 issue of *Pulp & Paper*, p. 57, and the Oct. 27, 1969 issue of *Paper Trade Journal*, pp. 60-61. In installations wherein a pool of coating liquid is accumulated at the nip between the two rolls, the coater may also be known as a "flooded nip" coater. Another version, involving the use of several applicator rolls in sequence, called the Champflex Coater, is disclosed at pages 56-57 of the Apr. 29, 1963 issue of *Pulp & Paper*. Also, dip roll applicators may be used in combination with other coaters for precoating or prewetting the web, as is shown for example in the illustration of the Kohler Coater in *Pulp and Paper Manufacture*, p. 511, and also in Damrau et al patent 4,250,211 and Damrau patent 4,310,573.

A major shortcoming of dip roll coaters is the development of film split pattern in the final coated web, i.e., the appearance in the coating of substantially continuous longitudinal stripes or lines, as web coating speeds are increased upwardly above 2,500 feet per minute and coatweights exceed about 5½ bone dry pounds per side per 3,300 square foot ream.

A third generation of blade coater, called the flexible blade or "Flexiblade" Coater, is comprised of a closed, pressurized, coating application chamber which sealingly engages the roll supported web, usually near the bottom of the backing roll, and has a back, rear or outgoing wall comprised of a flexible blade for spreading the coating material uniformly on the web surface. The "Flexiblade" Coater made by The Black-Clawson Company is disclosed in Jacobs et al. patent 3,079,889 and in an article appearing in the Apr. 8, 1963 issue of *Paper Trade Journal*. It is also briefly described at p. 57 of the Apr. 29, 1963 issue of *Pulp & Paper* as well as other trade periodicals, both U.S. and foreign.

Other flexible blade coaters employing a closed or sealed, pressurized application chamber are described in patent 2,796,846 to Trist and patent 3,273,535 to Krikorian.

In another variant of the sealed chamber type of coater, coating liquid under pressure is extruded onto the web in the closed application chamber and an excess of coating is metered onto the traveling web by a metering bar at the rear or outgoing end of the chamber and the excess is then removed and the coating leveled to its final coat weight thickness by an inverted trailing blade engaging the web downstream from the metering bar. Patents describing coaters of this type include Galer 3,192,895, Hunger 3,486,482 and Nagler 3,518,964. Of the three, the patent to Hunger 3,486,482 is the most representative.

The closed chamber type of coaters suffered the problem of excessive web breaks due to engagement of the traveling paper web with the mechanical sealing means required at the incoming, front or upstream end of the closed application chamber. Efforts to alleviate the problem, for example, by the use of flexible blade seals, such as those of Trist, or by spacing the Jacobs et al. seal member slightly from the web as suggested in the literature, failed to cure the problem. As a consequence, closed chamber coaters, including the Black-Clawson "Flexiblade" Coater, have been substantially if not entirely replaced by subsequent developments in paper coating technology. The above described variant thereof, as represented by the patent to Hunger, is not known to have been used commercially at all.

A fourth generation of blade coater, which was introduced by Black-Clawson as a replacement for the "Flexiblade" Coater, is characterized by an inverted trailing blade preceded by a fountain applicator which, like a dip roll, applies an excess of coating liquid to the web, which excess is subsequently removed and the coating leveled to its desired thickness by the trailing blade. Apparatus of this type, which are called Fountain Blade Coaters, are described in the Mar. 13, 1967 and May 13, 1968 issues of *Paper Trade Journal* (at pp. 52-53 and 64-67, respectively) and in a paper presented by Black-Clawson at a *Tappi* conference in 1978, and are disclosed in detail in the patents to Phelps et al. 3,418,970, Penkala et al. 3,453,137 and Coghill 3,521,602. A competitive apparatus, employing a jet applicator rather than a fountain applicator, is described in the German periodical *Das Papier*, No. 7, 1972, pp. 332-338, at page 334. Similar disclosures appear in an article by Ing. Josef Geistbeck, appearing in the German publication *Walzen Und Glattschaberstreichanlagen*, and in German Auslegeschrift No. 2359413.

With these prior art fountain and jet applicators, the amount of excess coating that is delivered to the trailing blade is purportedly metered onto the web by a metering or overflow strip which is located at the downstream edge of the applicator and adjustably spaced from the surface of the web to accomodate the escape of coating liquid between the web and the overflow strip. In use, these coaters encounter difficulties when running at high speed because the web catches on the metering bar and tears, thereby producing web breaks and causing machine down time and loss of production.

Some prior art coaters inherently employ a relatively long coating liquid dwell or soak time on the web, i.e., the time interval between the initial application and final blading of the coating. As a result, the water portion of the coating composition, as well as the water soluble or dispersable materials contained therein, migrate into the moving web at a more rapid rate than the pigment and eventually cause an undesirable imbalance in the coating constituents and their rheological properties. Long soak periods are also incompatible with the application of successive wet coats without intervening drying, i.e., wet on wet coatings, because the successive coat tends to migrate into and contaminate the previous coat.

In an effort to control soak time, Black-Clawson introduced a variation of its fountain blade coater wherein the fountain applicator and the doctor blade are separate assemblies and are relatively adjustable toward and away from one another in order to vary the dwell time of the coating on the web between application and doctoring. This coater, called the Vari-Dwell Coater, is described in the proceedings of the *Tappi* 1986 *Blade Coating Conference*, pages 109-113, and the *Tappi* 1987 *Coating Conference*, pages 141-149.

The problems associated with long dwell times are discussed in Neubauer U.S. Pat. No. 3,348,562, who discloses a coater wherein a narrow stream of viscous coating is extruded onto an inverted trailing blade that defines a nip region with the roll supported web. Since the coating is bladed immediately after application, soak times are purportedly kept to a minimum. However, the coating application is such that the coating material is unpressurized after leaving the orifice and is supported on the blade or trailing side only, with the leading side of the stream being unsupported and exposed to the environs in the zone of application. Consequently, the coating material is not properly o uniformly applied to the web. Disclosures of a related nature are contained in patent 3,484,279 (FIG. 3) to Clark et al. and patent 3,070,066 to Faeber.

The fifth generation of blade coater comprises the short dwell time application coater or "SDTA" coater which is rapidly replacing the prior art blade coaters. In essence, the closed chamber, flexible blade, fountain blade and jet applicator coaters have been rendered obsolete, and the puddle and roll type coaters are being relegated to web precoating or prewetting functions in wet on wet coating systems. The short dwell time or "SDTA" coater is disclosed in detail in patent 4,250,211, and its advantages are discussed in the May 1984 issue of *Pulp & Paper*, pages 102-104.

The "SDTA" coater is characterized by a coating application chamber having a very small dimension in the direction of web travel, a doctor blade pressure loaded against the coated web at and defining the downstream or web outlet end of the chamber, a novel liquid seal formed within a fairly generous gap defined between the applicator and the web at the upstream or web inlet end of the chamber, and means for supplying coating liquid to the chamber under pressure and in such copiously excess quantities as to cause a continuous high volume flow of coating liquid through the gap out of the upstream or front end of the chamber reversely of the direction of web travel, thereby to form and maintain a liquid seal within the gap and to maintain the coating liquid under pressure in the chamber and as it is applied to and doctored off the web; the doctoring occuring immediately at the downstream end of the application zone while the coating liquid is maintained under pressure. The flow of excess coating liquid through the gap defined between the web and the front edge of the application zone, in the direction reverse to the direction of movement of the web, is such that the gap is continuously and completely filled with reversely flowing coating liquid in quantity sufficient to: (a) close and seal off the gap at the front edge of the zone to maintain the pressure application of the coating liquid to the web within the application zone; (b) strip air off the web as it approaches and enters the application zone, thereby to eliminate air induced skips and voids in the layer of coating applied to the web and insure uniform overall coating of the web; (c) prevent entrainment of air in the coating liquid in the application zone and in the coating liquid that is applied to the web, thereby to eliminate coating imperfections due to the presence of air bubbles in the coating on the web; (d) prevent entry of foreign matter through the gap into the application zone and the coating liquid therein; and (e) continuously clean and purge the application chamber and application zone to insure the integrity, homogeneity and uniform distribution of a continuously fresh supply of coating liquid within the application zone, and to ensure that no foreign matter or impurities, e.g., lumps or coagulated coating, reach the doctor blade where they could cause scratching of the coating or create other problems deleterious to the coating process, or result in web breaks.

Due to the facts that the moving web of paper is pressed firmly, continuously and tightly against the surface of the backing roll by the reversely flowing liquid seal at the front or web entry end of the application zone, by the pressure of the coating liquid within the application zone, and by the pressure loaded doctor blade at the rear or web exit end of the zone, the web cannot catch or snag on coater components and the web breaking and other disadvantages of prior art coaters are eliminated. Consequently, coating compositions can be applied to the web under pressure within a short dwell time, free of skips and voids even at very high web speeds. The SDTA coater has proven itself in use at speeds up to 4000 feet per minute ("fpm") and beyond to apply a more uniform layer of coating onto a web than any prior art coater.

Characteristics of the applied coating can be varied or enhanced by precoating the web, e.g., by a roll applicator as shown in patent 4,250,211 and improvement patent 4,310,573, or by use of an internal leveling blade as disclosed in improvement patent 4,369,731, or by use of a second, internal liquid seal as disclosed in improvement patent 4,452,833, or by use of other improvements of note such as disclosed in patents 4,396,648, 4,440,105, and 4,503,804.

A proposed variation on the SDTA coater, one version of which is disclosed in FIG. 3 of Wohlfeil patent 4,706,603, involves essentially closing off the gap between the coater and the web at the upstream or web inlet end of the coating application chamber and draining excess coating from the chamber via drain holes in the upstream or front wall of the application chamber; the rate of drainage being such as to maintain the coating liquid in the chamber under pressure and to insure a sealed relationship between the web and the coater at the web inlet end of the application zone.

Another variant, a version of which is disclosed in Michael A. Mayer et al. U.S. Pat. No. 4,963,397, involved utilization of a short dwell type of apparatus to rework a previously applied excess layer of coating liquid, e.g., a dip roll applied excess layer, to distribute over the web a more uniform layer of the coating; specifically, a layer of coating that is free of the film split pattern of dip rolls when operated at speeds above about 2,500 fpm; the blade of the short dwell coater being used to remove excess coating from the web and to smooth and level the coating to the desired wet film thickness and coat weight; the excess coating removed by the blade being drained away via the SDTA, e.g., in a manner such as disclosed in Wohlfeil. For another variant, see also Wayne A. Damrau U.S. Pat. No. 4,859,507.

While the SDTA, including the above-described variation and variants thereof, has significantly advanced the state of the art, it has not provided a final solution to all the expectations of the paper coating industry. As the industry presses forward to attain even greater capacity, efficiency and economy in the production of coated papers, even the SDTA coater has on occasion produced coated papers that would not satisfy the increased demand for high quality coatings at higher web speeds. In particular, when applying heavier weight coatings, for example, 5½ and more pounds per side per 3,300 square foot ream, to the higher grades of paper webs, e.g., groundwood free merchant grades, at ever increasing production speeds, SDTA coatings, though of substantially uniform thickness and free of skips and voids, have exhibited decreased surface smoothness and streakiness in the direction of web travel through the coater, i.e., so-called machine direction or "MD" streakiness. Precoating or prewetting the web or reworking a previously applied excess coating on the web will not eliminate these problems. Dip roll applicators in particular encounter their own inherent limitations at web speeds in the order of 2,800 fpm due to splitting of the film of coating liquid being applied by the roll, resulting in a nonuniform coating having a longitudinally streaked or striped appearance, i.e., film split pattern.

While the SDTA coater and the above-described variants thereof can in most instances eliminate the film split pattern of the dip roll coating, MD streakiness and/or unacceptably diminished surface smoothness, i.e., surface roughness, may still result. Thus, whether used alone or in combination with a dip roll applicator, existing apparatus and methods, when operated at higher speeds to apply heavier weight coatings, may not in all cases produce a coated paper that will satisfy the exacting demands of the high quality printing, graphic arts and publishing trades.

SUMMARY OF THE INVENTION

The present invention comprises an improved paper coating apparatus and method capable of extremely high speed production of coated papers fullfilling the exacting demands of the trade, and specifically eliminating both film split pattern and MD streakiness in heavier weight coatings produced at high web coating speeds. The invention provides an improved coater and coating method making non-conventional use of SDTA type applicator apparatus for distributing excess coating liquid in a highly turbulent state over the surface of the web, and utilizing primary and secondary trailing blades for effecting precisely controlled sequential doctoring of the excess to the final wet film thickness of coating desired on the web; the primary blade being located at the downstream or web outlet end of the distribution zone of the apparatus and doctoring onto the web a substantially uniform layer of coating having a limited or controlled thickness which is in excess of the desired final wet film thickness (and significantly in excess of that conventionally applied by an SDTA coater); the secondary blade being spaced downstream from the primary blade and being physically and hydrodynamically isolated from the coating application zone; the secondary blade doctoring the primary blade's limited excess of coating off the web and leveling and smoothing the retained coating to the final wet film thickness desired.

As used in accordance with the present invention, the SDTA type of apparatus is effective to distribute over the entire surface of the high speed traveling web, within a limited application zone, an excess of coating that is entirely free of skips, voids, film split pattern and other imperfections, except MD streakiness and surface roughness. Due to the liquid turbulences, eddy currents and other hydrodynamic disturbances that are generated in the coating liquid in the application zone of the apparatus at very high web speeds, the coating medium in the zone exhibits extreme hydrodynamic impulse variations and fluctuations across the width of the web which cause transversely shifting variations across the width of the web in the thickness or caliper of the coating liquid being applied to the web, i.e., cross direction or "CD" caliper variations, which result in overall MD streakiness, diminished surface smoothness, and other imperfections in the final coated web.

According to the present invention, the primary blade is utilized to contain and isolate the hydrodynamic pressure fluctuations and impulse forces, and to gain a preliminary degree of control over the coating to be retained on the web, but without overwhelming the primary blade. First, the primary blade is utilized to isolate the hydrodynamic eddy currents and turbulences with the application zone and to confine the same therein. Second, the primary blade is employed to doctor onto the moving web an excess of coating liquid in the form of a relatively quiescent layer having an overall high degree of uniformity, except for small but nevertheless unacceptable variations in CD caliper profile. Third, the primary blade effects a controlled doctoring of this quiescent layer to a limited thickness just sufficiently in excess of the desired final wet film thickness to accomodate a subsequent final wet film doctoring of the liquid on the web under optimum blading or doctoring conditions.

Even with a relatively light mechanical loading thereon, the primary blade in the coater of the invention results in transport to the secondary blade, on the high speed traveling web, of a generally uniform, relatively quiescent layer of coating liquid of precisely controlled and limited excess thickness that is free of skips, voids and other anomalies or abberations, other than the unacceptable variations in CD caliper profile.

The secondary blade of the coater of the invention is spaced downstream from the primary blade and is thereby isolated from the turbulences and hydrodynamic impulses generated in the application or distribution zone. Because the secondary blade is isolated from such forces and disturbances, and because the primary blade applies a carefully controlled and uniform though potentially imperfect layer of excess coating onto the web, and because the caliper variations in the layer of coating on the web are instable and continuously shift back and forth transversely of the web, the hydrodynamic pressure exerted by the coating medium on the secondary blade is extremely uniform and constant across the entire width of the blade. The secondary blade can therefore exert a constant doctoring pressure or force on the coated web substantially uniformly across the width of the web, thereby to produce an extremely uniform coating lay on the web, free of film split pattern, CD caliper variations and MD streakiness.

In addition, the surface of the final coating on the web exhibits increased smoothness over conventionally applied coatings, and as well, a significant decrease in blade scratches. The decrease in scratches may be attributed to the fact that the primary blade is continuously flushed with the excess coating liquid in the application zone so that any debris in the coating liquid supply is quickly flushed away from the primary blade and does not by-pass the primary blade to interfere with optimum operation of the secondary blade. Thus, use in accordance with the invention of two spaced blades working sequentially on the same coating results in a coating lay that is very smooth surfaced and substantially scratch free.

The dwell time of the relatively quiescent layer of coating liquid on the web, occasioned by the spacing between the primary and secondary blades, is beneficial in that it enables the boundary layer of coating next to the web to become somewhat immobilized, which immobilized coating uniformly supports the tip of the secondary blade so that the final leveling and smoothing of the applied coating takes place where the coating is quite stable, thereby to provide a very uniform coating entirely free of MD streakiness, and exhibiting smoothness and other quality improvements over conventionally applied coatings.

The invention further resides in preferred time intervals between the two blading operations and preferred minimum and maximum rates of delivery of excess coating liquid from the primary blade to the secondary blade to insure proper performance of the final blading operation. The invention also includes various precoating and/or web preconditioning techniques useful in producing extremely high quality coatings at very high production speeds.

The invention thus engenders a further step forward in the art of blade coating, and envisions improved multi-stage wet on wet coating methods.

Other objects and advantages of the invention will become apparent from the following detailed description, considered in conjunction with the accompanying drawings.

BEST MODE FOR CARRYING OUT THE INVENTION

Figure 1:
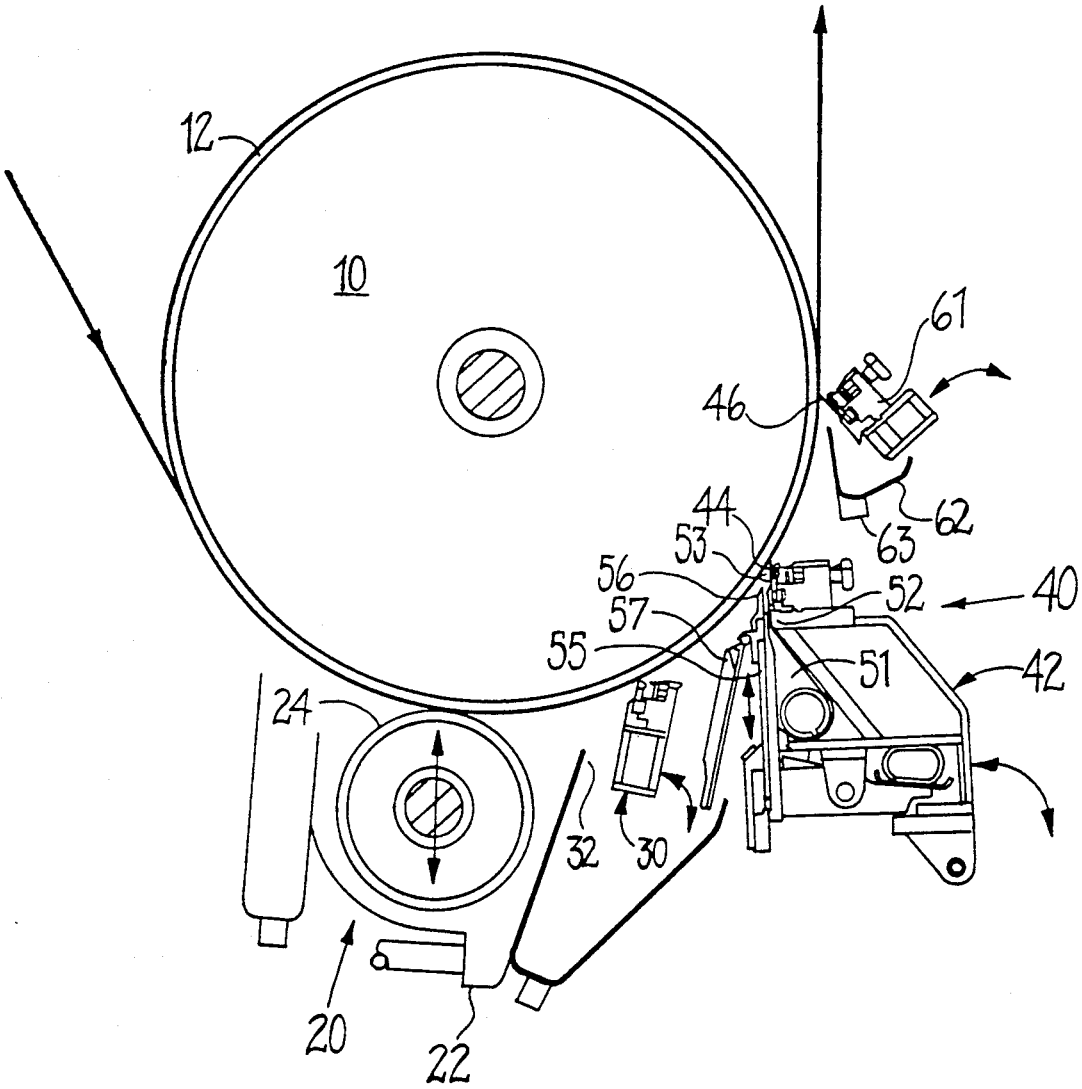
FIG. 1 is a schematic illustration, in side view, of a first embodiment of a paper web coating apparatus provided in accordance with the invention and comprised, in sequence in the direction of web travel on a web supporting roll, of a dip roll applicator, a preliminary treating or doctoring device, and the coater of the invention.

The following is a description of the best mode presently contemplated by the applicants for carrying out their invention. While the embodiments of the invention shown in the drawings are illustrated schematically in side view only, it is to be understood that the drawings represent fairly massive machine components having substantial width, e.g., 156 inches or more, in the direction perpendicular to the plane of the paper. Schematic illustrations suffice for purposes of disclosure to persons of ordinary skill in the art inasmuch as the individual machine elements are known in the art.

Figure 2:
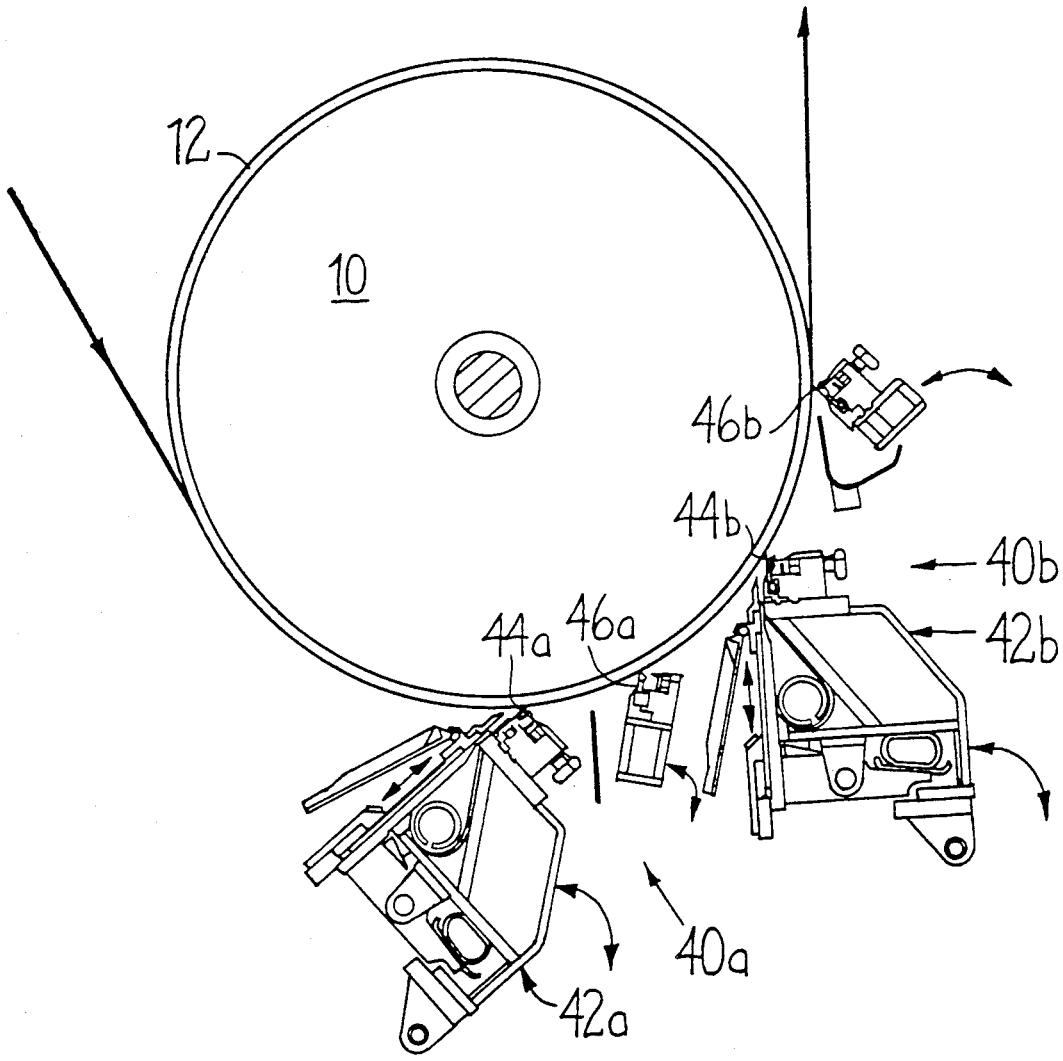
FIG. 2 is a similar schematic illustration of a second embodiment of a paper web coating apparatus provided in accordance with the invention and comprised, in sequence in the direction of web travel on a web supporting roll, of first and second ones of the coating apparatus of the invention.

Referring to the drawings, and particularly to FIGS. 1 and 2, a continuous web of paper traveling in the direction of the arrows at speeds of at least 3,000 feet per minute ("fpm"), and up to 4,000 and 5,000 fpm and beyond, is guided into engagement with the surface of a large diameter web supporting roll 10 rotating in the direction of web travel and having a resilient surface layer 12, the web preferably wrapping the roll over an arc of about 140 degrees.

The coating apparatus of FIG. 1 is comprised of a web backing roll 10 and, in sequence in the direction of web travel about the roll, a dip roll applicator 20, a first coating doctoring device 30, and the coater 40 of the invention, which is comprised of a non-conventionally operated short dwell time or SDTA applicator 42, a primary inverted trailing blade 44, and a secondary inverted trailing blade 46. The essence of the invention resides in the coater comprising the applicator 42, the primary blade 44 and the secondary blade 46. However, a dip roll applicator 20 has been shown as part of the apparatus because a dip roll can in many cases enhance the overall coating operation, especially when applying heavier coatings, by forcing coating composition into the interstices, voids and valleys on the surface of the web so that the subsequent coating can be applied to a more uniform surface which has been pretreated to provide for better holdout of the final coating. This in turn will impart a better ink holdout characteristic to the coated paper to enhance its printability.

Also, by mounting all of the coating instrumentalities for movement toward and away from the web, as indicate by the arrows, to accomodate selective use of the same, the apparatus of FIG. 1 provides a coating station having great universality of use.

FIG. 2 illustrates a coating apparatus provided in accordance with the invention and with which the ultimate in wet on wet coating techniques can be practiced. This apparatus comprises two of the coaters of the invention 40*a* and 40*b* mounted in sequence on a common web backing roll 10; the coaters being comprised respectively of an applicator 42*a*, a primary blade 44*a* and a secondary doctoring device 46*a*, and an applicator 42*b*, a semi-final blade 44*b* and a final blade 46*b*.

Figure 3:
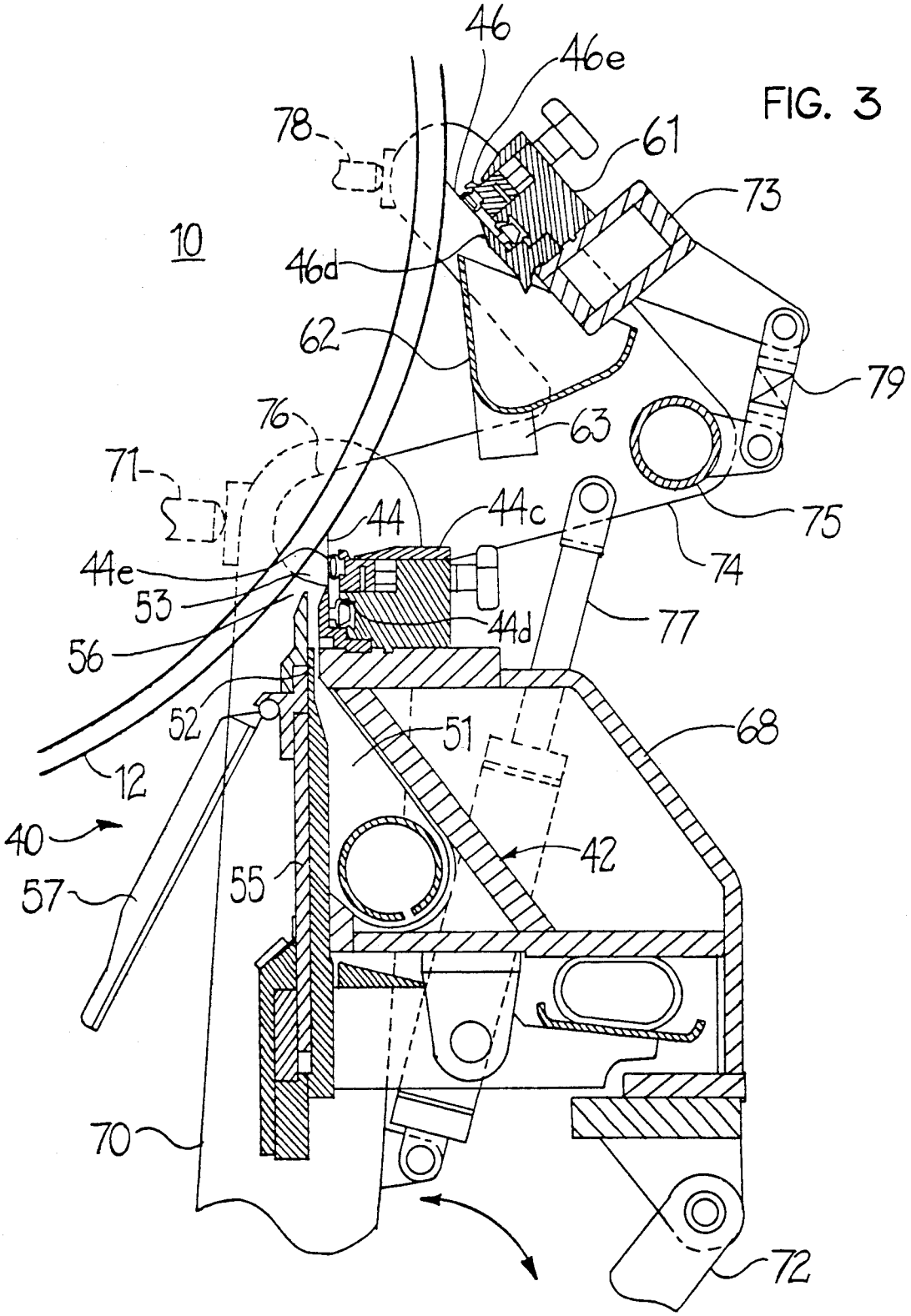
FIG. 3 is a side view, partly in vertical section, of a unitary coater provided in accordance with the invention.

FIG. 3 illustrates one embodiment of a physical construction of a unitary coater provided in accordance with the invention and comprised of an applicator 42, a primary trailing blade 44 and a final trailing blade 46.

The present invention embodies new and improved utilizations of SDTA coating technology in order to attain new and improved results heretofore unattainable. However, the construction of the applicator 42 as utilized in connection with the invention is, in general, much the same as illustrated and described in patents 4,250,211, 4,310,573, 4,369,731, 4,396,648, 4,440,105, 4,452,833 and 4,503,804, the teachings of which are incorporated herein by reference. As shown in the drawings, each applicator 42 comprises a coating composition receiving chamber 51 to which coating liquid is delivered from a source of supply in large quantity and under pressure; suitable pumps and piping (not shown) being provided for the purpose. The coating liquid passes from the chamber 51 through a restricted orifice 52, which produces a highly uniform and evenly distributed flow of coating liquid into a pressurized coating outlet slot or application zone 53. The zone 53 is preferably closed at its rearward end by the primary doctor blade 44 which sealingly engages the coated web under pressure at the downstream, back or web exit end of the zone. A pair of edge dams or seals (not shown) seal off the opposite side edges of the zone. At the front or web entry end of the zone, an orifice plate 55 having an upper edge spaced from the web defines with the web a gap 56 within which a reversely flowing coating liquid seal is established during operation of the coater. The coating flowing reversely through the gap 56 is returned via a channel 57 to the coating liquid source of supply for recycling and recirculation to the coater.

Esoteric coating compositions are not required for practice of the invention. Compositions conventional for producing enamel coated printing papers for the graphic arts and publications trade are preferred. A suitable composition comprises a starch-latex adhesive system with clay and/or calcium carbonate at 62% solids and a Brookfield viscosity of 5200 centipoise ("cps") at 20 revolutions per minute ("rpm"). Many other suitable coating compositions are known in the art.

As indicated by the arrows in FIGS. 1-3, the applicator 42 is adapted to be moved toward and away from the roll 10 to accomodate threading of the web through the coater and to accomodate variable positioning of the applicator relative to the roll supported web.

Coating liquid is supplied to the chamber 51 of the applicator 42 under pressures and in copious quantities sufficiently in excess of that to be applied to the web to cause coating liquid to completely fill the gap 56 and to flow continuously through the gap 56 reversely of the direction of web travel substantially uniformly across the entire width of the application zone. The size of the gap 56 and the pressure and the quantity of the coating liquid forced through the gap reversely of the direction of travel of the speeding web are correlated to one another to ensure that the gap is completely and continuously filled with reversely flowing coating liquid sufficient to:

a) completely close the gap 56 and seal off the front edge of the application zone 53 to ensure pressure application of the coating composition to the web;
b) strip air off the surface of the web as it approaches and enters the coating application zone 53 to prevent air induced skips and voids in the coating subsequently applied to the web;
c) prevent entrainment of disruptive air bubbles in the coating liquid within the application zone and the coating liquid applied to the web;
d) prevent entry of foreign matter into the application zone and the coating liquid therein; and
e) continuously purge the entirety of the coating delivery lines, the inlet chamber 51, the restricted orifice 52, the application zone 53 and the gap 56, thereby continuously to ensure the integrity, homogeneity and uniform distribution throughout the application zone of a continuously fresh supply of coating liquid free of foreign matter and impurities.

Because of the advantages that flow from the above described construction and mode of operation of the illustrated applicator 42, it is preferred in practice of the present invention to utilize apparatus and a method of operation as described, i.e., wherein coating liquid is applied under pressure to the web within a limited application zone 53 and copious quantities of the coating liquid are flowed reversely of the direction of web travel through a gap 56 at the front or upstream edge of the application zone 53 to form a liquid seal within such gap. However, it is believed feasible to utilize the proposed variation disclosed in FIG. 3 of Wohlfeil patent 4,706,603 and/or the variants disclosed in Mayer et al. patent No. 4,963,397 and Damrau patent No. 4,859,507, should one desire to do so. Thus, references to the application zone 53 and to the distribution of coating liquid in a turbulent state over the surface of the web should be understood to encompass variants as well as the preferred embodiment.

When constructed and operated in accordance with the preferred guidelines described, prior art SDTA coaters have been effective to apply a very uniform coating to the web. With and without a dip roll, the SDTA has produced extremely high quality coatings of various weights on a variety of base sheets at various speeds. Commercial operations are routinely conducted at 3,250 fpm for applying coat weights up to about 5 to 6 bone dry pounds per side per 3,300 square foot ream to groundwood paper webs, and experimental operations on lighter weight coatings have been observed at speeds up to 5,000 fpm. However, when applying coat weights in excess of about 5½ pounds per ream per side to the higher quality grades of paper, e.g., merchant grade web offset papers, especially free sheets having no groundwood, SDTA coatings tend to exhibit a streaky pattern, i.e., MD streakiness, as web speeds approach and exceed 3,000 fpm.

Having found a method that cures the problem, i.e., by virtue of the present invention, it can now be said, with the benefit of hindsight, that certain factors contribute markedly to MD streaking at higher coat weights. First, the increase in the velocity of the web passing through the distribution or application zone 53 in a given unit of time so intensifies the development of primary vortices and secondary vortical fluid motions and/or other disturbances in the coating liquid in the zone that irregular and variable hydrodynamic impulse forces are exerted by the liquid against different portions of the blade 44 across the width of the coater. Second, because the blade 44 is pressed mechanically against the web at less pressure for higher coat weights than it is for lower coat weights, the blade is less resistant to irregular and variable hydrodynamic impulse forces imparted thereto by the liquid and will permit passage of more coating under the portions thereof having a high hydrodynamic liquid force thereon than under the portions thereof having a lesser hydrodynamic liquid force thereon. This results in variations across the width of the web in the thickness or caliper of the layer of coating applied to the web. Such variations, though very slight, render the coated paper unacceptable. Because the locale of the irregular and variable impulse forces acting on the blade will inherently shift back and forth in directions transversely across the web due to the irregular nature of the turbulence of the liquid in the application or distribution zone, these cross direction or "CD" variations in the caliper of the coating will not simply leave one or more continuous longitudinal streaks in the coating, but instead will impart an overall streaky appearance to the coated web. The streaky appearance renders the coated paper unacceptable for quality printing and the graphic arts.

In contrast to prior art SDTA practices, wherein the SDTA coater is self-contained and the SDTA doctor blade is mechanically loaded at a sufficiently high pressure against the roll supported web to level the coating composition to final wet film thickness, coat weight and surface smoothness, the present invention, in its preferred embodiment, teaches operation of the applicator portion of an SDTA in a non-conventional manner. Specifically, as used in accordance with the present invention at web speeds in excess of 3,000 fpm, the applicator 42 distributes coating liquid in a turbulent state over the surface of the high speed traveling web to impart thereto an excess of coating that is continuous and entirely free of skips, voids and film split pattern, but otherwise somewhat irregular.

The primary blade 44 of the invention is pressed against the roll supported web at a relatively low mechanical loading pressure adjacent the outlet end of the turbulent zone. Despite the light mechanical loading thereon, the primary blade 44 confines and isolates the highly turbulent mass of coating liquid within the application zone 53 and doctors onto the web a relatively quiescent layer of coating having a thickness in excess of the desired final wet film thickness of the coating on the web. Though the excess layer from the primary blade 44 will embody CD caliper variations and exhibit a streaky pattern, the layer of coating on the web is nevertheless a generally or substantially uniform layer; specifically, a much more uniform layer than can be applied with a dip roll or any other presently known apparatus.

In addition, even though the primary blade 44 is biased against the web at a relatively low mechanical loading pressure, the primary blade effectively controls the amount and overall average thickness of the coating applied to the web so that only a limited excess of coating liquid remains on the high speed traveling web; specifically, an excess providing for rates of delivery, within minimum and maximum limits, of excess coating liquid to the secondary blade 46 sufficient to accomodate optimum wet film doctoring at the secondary blade, but not so excessive as to overwhelm the hydrodynamic capacity of the secondary blade. With the coater of the invention, the amount or rate of delivery of excess coating liquid to the final blade is more accurately controlled, and is significantly less, than with any presently known coating apparatus.

Thus, primary blade 44 of the coater of the invention provides for delivery to the secondary blade 46 of the coater of a continuous, uniform, essentially quiescent layer of coating liquid of limited excess thickness that is free of skips, voids and other anomalies, except unacceptable variations in CD caliper profile.

The secondary blade 46 of the coater of the invention is spaced downstream from the applicator 42 and the primary blade 44 of the coater, in physical isolation from the hydrodynamic impulse forces generated in the application zone 53, and is pressed uniformly and tightly against the web to perform a final blading action on the non-turbulent essentially quiescent layer of coating liquid that is doctored onto the web by the primary blade 44. The blade 46 is mounted in a blade holder 61 which, as indicated by the arrows, may be moved toward and away from the roll 10 to accomodate threading of the web through the coater and to permit adjustment of the blade relative to the roll supported web. Excess coating removed from the web by the blade 46 is returned to the source of coating supply via a catch pan 62 and suitable piping 63 for recycling and recirculation to the applicator 42.

The excess amount of coating liquid on the web between the primary blade 44 and the secondary or final blade 46 must be adequate to maintain sufficient coating liquid at the nip between the blade 46 and the roll supported coated web to ensure that the final blading operation is carried out under wet blading conditions; to provide for adequate run off from the blade to purge the blade, flush away debris and keep the blade clean; and to prevent drying or coagulation of the coating composition on or before the final blade 46. On the other hand, the amount of excess should be limited to the extent feasible to accomplish the foregoing operational objectives and, at the same time, to minimize the work load on the final blade, to avoid overloading the blade hydrodynamically, and to avoid exceeding the capacity of the coater to dispose of excess coating liquid via the catch pan 62 and piping 63.

Also, the spacing between the blades 44 and 46 must be such as to provide a controlled dwell time of the coating on the web and assure optimum blading conditions at the final blade.

Assuming these conditions are satisfied, preferably in the manner and within the parameters explained in greater detail hereinafter, the layer of coating composition delivered to the blade 46 will result in imposition on the blade of a very uniform and constant hydrodynamic pressure across the entire width of the blade, essentially if not completely free of irregular and variable impulse forces. This is accomplished by reason of the facts that (a) the final blade 46 is physically removed from the application zone 53 and thus isolated from the nonuniform and turbulent hydrodynamic impulse forces generated within the zone 53, (b) the layer of coating doctored onto the web by the primary blade 44 is in fact essentially uniform, (c) the amount or thickness of the layer of coating liquid doctored onto the web by the primary blade is only of a minimal limited excess optimum for final wet blading, and (d) the CD caliper variations in such layer of coating are not constantly in the same location on the web, but shift back and forth transversely of the web, so that the layer of coating as it encounters the blade 46 is of an essentially uniform and constant thickness across the entire width of the coated web. The hydrodynamic pressure or impulse force of the coating medium on the final blade is therefore very uniform and constant across the entire width of the blade, and the blade can be mechanically loaded uniformly across its width to exert an essentially uniform and constant leveling and blading force on the coated web to impart thereto an extremely uniform coating lay free of CD profile variations and MD streakiness. The resultant uniform coating exhibits a significant increase in surface smoothness and a significant decrease in blade scratches.

Due to the fact that there is some dwell time of the excess coating on the web in the interval between the two blades 44 and 46, the boundary layer of coating immediately adjacent the surface of the web will become somewhat immobilized and the final blading will take place within this immobolized boundary layer or zone, where the coating is quite stable, so that the tip of the final blade 46 is uniformly supported by such layer and therefore functions more effectively to impart a uniform and smooth surfaced coating on the web.

Due to the construction and mode of operation of the coater of the invention, the coater is essentially free of self-induced or self-propogated breaks in the high speed traveling web. Specifically, as the moving web of paper approaches the preferred embodiment of the coater of the invention, it is pressed firmly, tightly and continuously over its entire surface area against the surface of the backing roll 10 by the liquid flowing reversely through the gap 56 at the front or web entry end of the coating application zone 53 and by the pressure of the coating liquid within the zone 53. Consequently, the web cannot catch or snag on the orifice plate 55 or any other coater components, and the web is fed in a firmly and smoothly supported condition to the primary blade 44. The blade 44 in turn applies an essentially uniform mechanical loading force on the roll supported web at the rear or web exit end of the zone 53. The web therefore leaves the blade 44 in firm, tight and continuous engagement with the surface of the roll, and with a generally uniform layer of coating thereon, so that the web moves without distortion or displacement relative to the roll to the blade 46 for fully supported, very uniform and smooth final blading of the coating thereon. Also, because the application zone 53 is so small and such intense eddy currents are developed in the coating liquid therein at high web speeds, the coating composition does not coagulate or develop lumps or particulate clumps that could lodge on either of the blades to cause streaks, scratches or breaks. Thus, web breakage and resultant downtime are rarely if ever caused by the coater of the invention.

To attain the best results from the coater of the invention, the applicator 42, the primary blade 44 and the final blade 46 should all contact the roll supported web within the lower quadrant on the upwardly moving side of the roll 10, i.e., intermediate the six and three o'clock positions as the coater is illustrated in FIGS. 1-3. In order to accomodate web pre-coating apparatus, such as illustrated in FIGS. 1 and 2, it will usually prove desirable, and it is therefore preferred, to have the tip of the final blade 46 contact the roll supported web at or in close proximity to the horizontal centerline of the roll 10 on the upwardly moving, outgoing side of roll, i.e., at the three o'clock position as the coater is illustrated in FIGS. 1-3. The tip of the primary blade 44 should contact the roll supported web from about 4 to about 24 inches upstream from the tip of the blade 46 when operating at web speeds of 3,000 to 5,000 fpm. With a conventionally or appropriately sized backing roll 10, such as a 50 inch diameter roll, we have found it preferable to have the primary blade 44 contact the web in the order of about 30-40 degrees upstream from the final blade 46, i.e., in the vicinity of the four o'clock position as illustrated in FIGS. 1-3. This location assures optimum operation of the applicator 42 and the blade 44; provides for adequate but not excessive dwell time of the coating on the web before final blading; provides sufficient space within which to mount the catch pan 62 and piping 63; and results in a compact physical construction that will accomodate installation of selected precoating apparatus between the bottom dead center position of the roll and the applicator 42, as is illustrated in FIGS. 1 and 2.

In addition, in order to achieve the above described mode of operation and attain the best results from the coater of the invention, it is necessary to observe and adhere to various operational criteria. In respect of the preferred embodiment of the coater of the invention, the upper edge of the orifice plate 55 of the applicator 42 should be spaced from the surface of the web by a dimension within the range of about 1/16 inch to about ½ inch, preferably within the range of ⅛ to ⅜ inch; the plate 55, as indicated by the double headed arrow thereon, being slidably mounted on the body of the applicator to accommodate such adjustment. Coating liquid is preferably supplied to the chamber 51 at a pressure in the range of from about 7 to about 100 inches of water (¼ to 3.5 pounds per square inch, "psi"), and in quantities sufficiently in excess of that applied to the web to cause a reverse flow of coating liquid through the gap 56 adequate to completely and continuously fill said gap with reversely flowing coating liquid substantially uniformly across the width of the web. Reverse flow through the gap 56 should preferably be in the order of about 0.75 to about 2.0 or more gallons per minute ("gpm") per inch of web width.

With a sufficient amount of coating liquid delivered to the chamber 51, under sufficient pressure, the coating composition will be applied under pressure to the web within the application zone 53. The dimension of the zone 53 in the direction of web travel, depending upon web speed, may be in the order of from about ¼ to about 4 inches, preferably about ½ to about 1½ inches. In most commercial operations to date, the dimension has been in the order of about ¾ to about 3 inches, usually about 1 inch, so that the distribution of turbulent coating liquid onto the web is of short duration, i.e., short dwell, in the order of abut 0.0004 to about 0.0100 of a second.

The thus distributed coating is then immediately doctored, preferably while under pressure at the web exit end of the zone 53, by the primary blade 44. The blade 44 must be adjusted to press against the coating applied to the web in the zone 53 in such manner as to doctor onto the web a layer of coating having a thickness in excess of the desired wet film thickness of the final coating on the web. As above stated, the amount of the excess must be carefully controlled to insure delivery of excess coating liquid to the blade 46 in an amount and at a rate that will provide for optimum operation of the blade and prevent imposition of undue hydroynamic impulse forces on the blade. On trial runs at web speeds of 3,000 fpm to 4,000 fpm, utilizing a coating composition having 62% solids, it has been found that the amount of the excess should be at least about 0.25 gpm per inch of blade width and should not exceed about 0.75 gpm per inch of blade width. Stated in inches of wet film thickness, the film doctored onto the web by the primary blade should be from about 0.0010 to about 0.0040 inch thicker than the desired final wet film thickness. Depending upon the final weight of the coating to be retained on the web after final blading at 46, and the amount of excess to be delivered from the primary blade 44 to the final blade 46, the pressure exerted on the coated web by the tip of the blade 44 should preferably be within the range of from about 1.0 to about 4.5 pounds per lineal inch ("pli").

Another, more accurate and less variable dependent, description of acceptable limits on the layer of coating between the two blades 44 and 46 would be to define the same in terms of bone dry coat weights per 3,300 square foot ream ("lbs/rm"). Based on the trial runs above referred to, and assuming final bone dry coat weights within the range of 5 to 15 pounds per ream, the amount of coating metered onto the web by the blade 44 should be such as would result in bone dry coatings within the range of about 25 to about 85 bone dry pounds per ream. Based on a bone dry analysis, the layer of coating applied by the primary blade 44 should be in the order of about 2 to 10 times the final coat weight of the coating that is doctored to the web at the blade 46.

With lesser excess flow rates than above stated, the amount of excess coating is not sufficient to purge and flush the blade 46 and to flow continuously from the blade into the catch pan 62. Coating solids build-up would occur and greatly hamper runnability of the coater. Consequently, there would be no assurance that the blade 46 would operate cleanly in a wet layer continuously across the web, and coating in the vicinity of the blade 46 could potentially coagulate and impair the efficient operation of the blade, possibly causing blade scratches and streaks in the final coating. Excess flow rates greater than the stated upper limit would be wasteful and inefficient and could result in hydrodynamic over-loading of the coating system and the final blade, and possibly result in the reintroduction of CD coating lay profile variations and MD streakiness. It is preferable to minimize the work required of the secondary blade 46 to insure that the blade tip exerts a uniform pressure across the entire width of the web. Thus, excess flow rates need to be maintained within acceptable minimum and maximum limits.

Also, the spacing between the blades 44 and 46, and thus the dwell time of the coating on the web between the two blades, must be maintained within acceptable upper and lower limits. The spacing should preferably be from about 4 to about 24 inches to maintain a dwell time in the order of from about 0.003 to about 0.040 seconds at web speeds of 3,000 to 5,000 fpm. This results in providing adequate dwell time for the boundary layer of coating at the surface of the web to become sufficiently immobilized and stabilized to provide for optimum operation of the blade 46 within this boundary layer or zone. Excessive dwell time, with consequent excessive immobilization of the boundary layer, is to be avoided as that would impose excessive operational requirements on the blade 46 and result in a less desirable final coat. In order to achieve a final bone dry coat weight of 5 to 15 pounds per side per ream with a 62% solids coating composition, the pressure exerted by the tip of the secondary blade 46 on the coated web should preferably be within the range of from about 2 pli to about 9 pli.

When operated under the described conditions, the secondary blade 46 will perform efficiently and effectively to doctor onto the web a very uniform and smooth surfaced coating free of MD streaking.

The improved coating method and coater of the invention, comprised of the non-conventional applicator 42 and the primary and secondary blades 44 and 46, thus cure the problems encountered with predecessor coaters and coating methods, including the conventional SDTA. However, on those occasions when it is desired to pre-coat the web, or to utilize first and second coating compositions having different characteristics and advantages, or to apply an especially heavy weight of coating to the web, it may prove advantageous to have a preliminary coater precede the coater of the invention.

For purposes of carrying out multiple coating processes in a wet on wet relationship, two of the coaters of the invention may be mounted for sequential application of coatings to a web supported on a common backing roll as illustrated schematically in FIG. 2, or a coater of the invention may be preceded by a conventional applicator as illustrated schematically in FIG. 1.

In the apparatus of FIG. 1, just before reaching the bottom dead center position of the roll 10, the roll supported web passes a dip roll applicator 20 having a coating reservoir or pan 22 within which a dip roll 24 is rotated to pick up coating composition from the pan and transfer it to the exposed lower surface of the web. As is known in the art, the dip roll 24 is rotated in such direction that the upper surface thereof moves in the same direction as but at a surface speed slower than that of the web. The roller may engage the web, or just kiss the web, or be spaced from the web depending upon the functions to be performed by and the nature of the coating to be applied to the web by the roll 24.

As indicated by the double headed arrow, the dip roll is independently movable toward and away from and adjustable relative to the roll 10 to accommodate threading of the web through the coater, to accommodate selective use of the dip roll, and to accommodate appropriate adjustment of the dip roll relative to the roll supported web.

If desired, the dip roll applicator 20 could be preceded and/or replaced by a puddle or pond coater located on the downwardly moving, incoming side of the roll 10.

As a further and highly advantageous alternative, the dip roll applicator 20 may be followed, as at 30, by pre-metering chamber means of the type disclosed in patent No. 4,963,397 or by jump shear plate means as disclosed in patent No. 4,859,507, the teachings of each of which are incorporated herein by reference. Use at 30 of the apparatus disclosed in either of said applications will eliminate or minimize the dip roll film split pattern that develops in the coating consequent upon operation of the dip roll at web speeds in excess of about 2,800 fpm, thereby to deliver a more uniformly pre-coated web to the applicator 42 and/or primary blade 44. Excess coating removed from the web by the apparatus 30 and/or overflowing the pan 22 is returned via channel 32 to a source of supply (not shown) for recycling and for recirculation back to the pan 22.

From the foregoing, the mode of operation of the coating apparatus illustrated in FIG. 2 will be apparent to those skilled in the art. In essence, the first coater 40*a* will apply to the web an even smoother and more consistent pre-coat than can be applied with a dip roll or any other presently known applicator or coater. Also, the capacity for selective use of the blades 44*a* and 46*a*, in conjunction with the blades 44*b* and 46*b*, provides the facility for subjecting the applied coating to two, three or four zones of shear at the nip between the coated web and respective ones of the four inverted blades, thereby to insure application to the web of very consistent and uniform coatings of very high quality and smoothness, free of MD streaking and other imperfections.

As an alternative, the secondary blade 46*a* of the first coater 40*a* could be replaced with the pre-metering chamber means or jump shear plate means 30 previously referred to. Thus, the FIG. 2 apparatus should be understood to comprise a first short dwell applicator 42*a*, a first doctoring means 44*a*, a secondary doctoring means 46*a* or 30, a second short dwell distribution apparatus 42*b*, a semi-final blade 44*b* and a final blade 46*b*, all selectively operable to achieve various paper coating objectives.

In the arrangement illustrated in FIG. 2, the tip of the final blade 46*b* should preferably engage the roll supported web at or in proximity to the horizontal centerline of the roll on the upwardly moving, outgoing side of the roll, the semi-final blade 44*b* should engage the web about 30° to 40° upstream from the final blade, the first applicator 42*a* should be on the upwardly moving side of the roll 10, suitably within about the first 25° downstream from the bottom dead center position of the roll, and the first primary blade 44*a* should contact the web at about 25° downstream from bottom dead center, i.e., 25° to 35° upstream from the semi-final blade 44*b*. If used, the secondary doctoring means 46*a* or 30 should be fitted between the blade 44*a* and the applicator 42*b* as best suited to the particular physical environment.

The purpose in utilizing two of the coaters of the invention in sequence on a common backing roll is to facilitate production of very high quality coatings on webs traveling at the highest speeds presently contemplated, i.e., 5,000 fpm.

Simulation studies reveal that web speed dominates the flow of the coating liquid in the application zone 53, whereas fluid rheology does not significantly alter flow characteristics at high web speeds, at least close to the nip between the web and the blade 44. At very high speeds, a high intensity vortex with counter rotating vortices is developed within the application zone, which generates extreme hydrodynamic instabilities that may be responsible for the difficulty in controlling CD coat weight uniformity. The simulation and the conclusions drawn therefrom would tend to explain the observation of unusual turbulence in the coating liquid flowing reversely through the orifice gap 56 at web speeds of 4,000 to 5,000 fpm.

The coater of the present invention provides the best means known of eliminating CD caliper variations and MD streaking, and utilization of two of the coaters in sequential order will ensure both a uniform pre-coat and a uniform final coat under conditions such that neither the secondary doctor 46*a* nor the final blade 46*b* will be subjected to nonuniform hydrodynamic impulse forces. Thus, the final coating, even at web speeds approaching 5,000 fpm, will fulfill all of the expectations and requirements of the graphic arts and quality printing and publication trades.

The current requirements in such trades for coated papers of the type intended to be produced by practice of the method of the invention with the apparatus of the invention are listed below. In the list of characteristics, "Printsurf" refers to Parker Printsurf printing surface smoothness (the lower the number, the smoother the surface); Paper Gloss is the gloss of the coated paper before printing, as measured at different angles of reflectance; and GIH is the gloss ink hold-out of the coated paper, using red and black commercial sheet offset inks, as measured at different angles of reflectance (a higher number indicating a better result).

| | |
|---|---|
| Paper Web: | Merchant grade paper having little or no groundwood with a brightness of 79 and above. |
| Coat Weight: | 5 to 15 lbs per side per 3,300 sq ft ream. |
| Appearance: | Overall uniformity of coating lay. No film split pattern or MD streakiness. No observable scratches or other imperfections in the coating lay. |
| Printsurf: | 1.10 and lower (lower number is smoother) |
| GIH Red 20°: | 40–70 |
| GIH Black 20°: | 20–50 |
| Paper Gloss 20°: | 15–35 |
| GIH Red 75°: | 80–100 |
| GIH Black 75°: | 80–100 |
| Paper Gloss 75°: | 60–90 |

The foregoing standards have been established in respect of coatings applied to merchant grade webs by means of a DRIB coater, i.e., a dip roll applicator and an inverted trailing blade, operating at speeds up to about 2,500 fpm. At speed in excess of about 2,500 fpm, a DRIB applied coating will no longer satisfy the "appearance" characteristic above stated, which is one of the most if not the most important of the requirements imposed by the trade.

The coating method and coater of the invention overcome this problem and provide coated papers meeting or exceeding all of the above requirements, and particularly the "appearance" requirement, even when operated at web coating speeds in excess of 3,000 fpm, and on up to 5,000 and more fpm. In addition, coated papers produced in accordance with the invention exhibit significant improvements over their DRIB coated counterparts in terms of significantly reduced blade scratches and significantly improved ink hold-out, gloss, and surface smoothness, all of which are very important characteristics of the coated paper. For example, when coating the felt side of the same paper with the same coating composition at the same coat weight and under comparable conditions, the coating method of the invention produced the following improvements in the coated web:

Coat Weight 12.5 lbs per side per 3,300 sq ft ream

| | DRIB | Method Without Dip Roll Pre-Coat | Method With Dip Roll Pre-Coat |
|---|---|---|---|
| Printsurf | 0.94 | 0.93 | 0.85 |
| GIH Red 20° | 54 | 58 | 64 |
| GIH Black 20° | 45 | 50 | 54 |
| Paper Gloss 20° | 31 | 36 | 35 |
| GIH Red 75° | 98 | 99 | 100 |
| GIH Black 75° | 95 | 96 | 97 |
| Paper Gloss 75° | 85 | 88 | 88 |

Thus, the invention provides significant advantages over the prior art and facilitates the production at ultra high speeds of coated papers fullfilling the exacting demands of the publication trades.

Operational criteria for representative trial runs of the coater of the invention at speeds of 3,000 to 4,000 fpm to produce coated papers that satisfy all of the above requirements and specifications and that are very smooth surfaced and free of MD streaking are as follows:

| | Sample No. | | | |
|---|---|---|---|---|
| | 1 | 2 | 3 | 4 |
| Final Coat Wt (lbs/rm) | 5.3 | 5.3 | 14.7 | 15.3 |
| Web Basis Wt (lbs/rm) | 49.1 | 51.6 | 42.3 | 42.2 |
| Web Speed (fpm) | 3120 | 3893 | 3045 | 3955 |
| Coating Supply (gpm/in) | 1.2 | 1.13 | 1.55 | 1.55 |
| Primary Blade Pressure (pli) | 2.3 | 2.3 | 1.5 | 1.5 |
| Primary Blade Metered to Web (gpm/in) | .321 | .385 | .413 | .487 |
| Primary Blade Metered Film Thickness (in) | .00198 | .00191 | .00261 | .00237 |
| Final Blade Pressure (pli) | 5.5 | 5.5 | 2.0 | 2.6 |
| Final Wet Coat on Web (gpm/in) | .054 | .067 | .147 | .198 |
| Final Wet Coat Film Thickness (in) | .000333 | .000333 | .000929 | .000964 |
| Excess Coating to Final Blade (gpm/in) | .267 | .318 | .267 | .289 |

Operational criteria for representative trial runs of the coater of the present invention preceded by a dip roll applicator 20 (i.e., the coating apparatus of FIG. 1 without the apparatus 30) to produce coated papers free of MD streaking and satisfying all of the requirements of the printing and graphic art trades are as follows:

| | Sample No. | | | |
|---|---|---|---|---|
| | 5 | 6 | 7 | 8 |
| Final Coat Wt (lbs/rm) | 5.3 | 5.8 | 14.3 | 14.1 |
| Web Basis Wt (lbs/rm) | 42.6 | 42.4 | 48.6 | 48.1 |
| Web Speed (fpm) | 3020 | 3926 | 3027 | 3859 |
| Dip Roll Speed (fpm) | 450 | 500 | 450 | 500 |
| Dip Roll Supply (gpm/in) | 2.18 | 2.46 | 2.18 | 2.46 |
| Applicator Supply (gpm/in) | 1.05 | 1.05 | 1.14 | 1.14 |
| Primary Blade Pressure (pli) | 2.3 | 2.3 | 1.7 | 2.0 |
| Primary Blade Metered to Web (gpm/in) | .329 | .789 | .664 | .738 |
| Primary Blade Metered Film Thickness (in) | .00210 | .00387 | .00423 | .00368 |
| Final Blade Pressure (pli) | 5.5 | 5.5 | 2.7 | 3.8 |
| Final Wet Coat on Web (gpm/in) | 0.052 | 0.074 | .141 | .178 |
| Final Wet Coat Film Thickness (in) | .000332 | .000363 | .000898 | .000888 |
| Excess Coating to Final Blade (gpm/in) | .277 | .715 | .523 | .560 |

All of the above described trials were made on the same laboratory pilot coater; the web was a web offset, merchant grade, free sheet; the coating composition comprised a starch-latex adhesive system with clay at 62% solids and a viscosity of 5200 cps at 20 rpm; the orifice gap 56 was 0.1875 inches from the web; the primary blade was 0.015 inches thick and its angle was 35° to the tangent of the roll 10 at the point of blade tip contact; the secondary blade was also 0.015 inches thick and its angle to the roll tangent was 45°; and the secondary blade 46 was spaced 13.1 inches circumferentially downstream from the primary blade 44. For the wet on wet coatings using the dip roll applicator 20, the surface of the roll 24 was spaced 0.005 inches from the web and the roll was driven at a surface speed between 13 and 15% of the speed of the web. All samples were completely coated without skips or voids. Paper gloss, smoothness and printability improvements were observed. Most importantly, the coated sheets exhibited no streakiness and fullfilled the "appearance" requirements of the trade.

Referring now to FIG. 3, a physical construction for the preferred embodiment of the coater of the invention is illustrated as comprising a short dwell applicator 42, a primary blade 44 and a secondary blade 46 all adjustably mounted on and carried by a common support structure.

The previously described components of the applicator 42 are mounted on and supported by a rigid transverse beam 68 which is mounted for pivotal movement toward and away from the roll 10 by means of a pair of pivot arms 70 which are pivotally mounted on the machine frame (not shown) on opposite sides of the frame outwardly of the opposite ends of the roll 10. The pivot arms 70 are adapted to be moved simultaneously by hydraulic or pneumatic rams or similar means (not shown) to swing the beam 68 and the applicator components supported thereby toward and away from the web supporting roll for shut-down, maintenance and cleaning, to facilitate threading of the web through the coater, and to adjust the position of the applicator relative to the roll supported web. Preferably, adjustable stops 71 are provided on the machine frame for engagement by the arms 70 to facilitate movement of the applicator into properly adjusted relation to the roll.

In the illustrated embodiment of the invention, the primary blade 44 is carried by the beam 68, and the beam 68 is journaled at its opposite ends on the pivot arms 70 for pivotal movement about a pivot axis that is essentially coincident with the tip of the blade 44. An adjusting means, such as a motorized screw jack, indicated fragmentarily at 72, is operable to pivot the beam supported elements relative to the arms 70 thereby to vary and adjust the angle of the primary blade 44 relative to the surface of the roll supported coated paper web. Alternatively, the blade 44 could be mounted on its own adjustable supporting structure for independent adjustment relative to the web.

The blade 44 is retained in a blade holder 44*c* by means of a first pneumatic tube 44*d*, or other suitable blade clamping means, and is adjustably biased against the roll supported coated web by means of a second pneumatic blade loading tube 44*e* which is adjustably mounted on the holder 44*c*. By adjusting the location of the tube 44*e* and the pressure of the air supplied thereto, the tip of the blade 44 can be pressed against the coated web at various blade tip pressures, as previously described.

As is known in the art, the blading action of a doctor blade on a coated web is a function of blade thickness, angle and loading. In the case of the primary blade 44 of the invention, we have successfully utilized a blade thickness of 0.015 inches and an angle of attack of about 35 degrees. The preferred loading on the primary blade is from about 1 to about 4½ pounds per lineal inch depending upon the physical characteristics and the amount of the coating to be doctored onto the web.

The secondary blade 46 in the illustrated embodiment of the invention is mounted on and supported by a rigid transverse beam 73 which is pivotally mounted at its opposite ends on a pair of V-shaped brackets 74 located at the two sides of the machine outwardly of the opposite ends of the roll 10, the two brackets 74 being tied together for conjoint movement by a tubular cross tie 75. The brackets 74 are pivoted at 76 to the pivot arms 70 supporting the beam 68, whereby the entire combination of elements comprising the coater can be swung simultaneously toward and away from the roll 10 without disrupting any previously established adjustments of the applicator 42, the primary blade 44 and the secondary blade 46.

An adjusting means, in the form preferably of a hydraulic or pneumatic ram 77, extends between each pivot arm 70 and the associated bracket 74 to adjust the position of the blade 46 relative to the applicator 40 and the roll supported coated web. Adjustable stops 78 are preferably provided for engagement by the brackets 74 to facilitate movement of the blade 46 into its adjusted position relative to the roll 10. Also, an adjusting means 79 extends between and is pivotally connected at its opposite ends to the bracket cross tie 75 and the beam 73 to pivot the beam about a pivot axis that is essentially coincident with the tip of the blade 46, thereby to adjust the angle of the secondary blade 46 relative to the surface of the coated web.

The secondary blade is mounted in its blade holder 61 by a first pneumatic tube 46*d*, or other clamping means, and is adjustably biased against the surface of the coated web by a second pneumatic blade loading tube 46*e*.

In practice of the present invention, we have successfully employed a secondary blade having a thickness of 0.015 and an angle of attack of about 45 degrees. The preferred loading for the secondary blade is from about 2 to 9 pounds per lineal inch, depending upon the coatweight of the coating to be finally doctored onto the web.

With the coater thus physically constructed, the present invention can be practiced with particular facility to attain all of the advantages herein described, and particularly to produce at very high web speeds coated papers having excellent surface characteristics entirely free of MD streaking and other imperfections.

While certain preferred embodiments of the invention have been illustrated and described, it is to be appreciated that various changes, rearrangments and modifications may be made therein without departing from the scope of the invention, as defined by the appended claims.

What is claimed is:

1. A method of rectifying the problems of an appearance of machine direction streakiness and reduced surface smoothness due to cross direction caliper variations in a coating applied to a moving web of paper by short dwell time type application means when operated at web speeds of 3,000 and more feet per minute, wherein the method includes the steps of moving the web in a given direction at a speed of at least 3,000 feet per minute, supporting the moving web through a portion of its path of movement, forming on the supported portion of the web a short dwell coating liquid application zone having a limited dimension in the direction of web movement and having rear and side edges effectively engageable with the supported web and a front edge spaced from the supported web and defining a gap between itself and the web at the upstream front edge of the application zone, forming and maintaining a reservoir of coating liquid in a turbulent state on the supported web within the application zone by substantially sealing the side edges of the application zone to the web and by forming a liquid seal between the turbulent liquid in the application zone and the surface of the web in the vicinity of the gap between the web and the front edge of the zone, continuously flowing an excess of coating liquid through the application zone for purging the zone, for forming and maintaining the liquid seal, and for excluding air and foreign matter from the coating liquid adjacent the rear edge of the zone, distributing coating liquid in a turbulent state over the surface of the supported web through the limited application zone, subjecting the coating liquid on the supported web to a primary doctoring immediately at the rear edge of the application zone, within about 0.0004 to about 0.0100 second of its turbulent application to the web within the zone, by means of a primary doctor blade biased under a relatively low doctoring pressure against the coated web to form on the traveling web a generally uniform and relatively quiescent layer of coating liquid having a wet film thickness sufficiently in excess of the final wet film thickness to accommodate a subsequent final wet film doctoring of the coating liquid on the web, and at a location spaced downstream from the rear edge of the application zone and physically and hydrodynamically isolated from the turbulent coating liquid in the application zone, but within about 0.003 to about 0.040 second following the primary doctoring step, subjecting the generally uniform and relatively quiescent layer of coating liquid on the supported web to a final doctoring by means of a final doctor blade biased under final doctoring pressure against the coated web to remove the excess coating from the web and to level and smooth the coating retained on the web to final wet film thickness and smoothness, the wet film thickness of the generally uniform and quiescent layer of coating liquid formed on the web by the primary doctor blade having a lower limit sufficiently in excess of the final wet film thickness to provide at the final doctor blade an excess amount of coating liquid adequate to cause a substantially continuous run-off of excess coating liquid from the final blade to purge and flush the final doctor blade, and having an upper limit preventing hydrodynamic overloading of the final doctor blade and minimizing the work required of the final doctor blade, the dwell time of the coating liquid on the web between the primary and final doctor blades enabling the boundary layer of coating liquid next to the web to become substantially immobilized for supporting the final doctor blade, whereby the final leveling and smoothing of the coating takes place where the coating is substantially stable, the final doctor blade being isolated from the turbulence of the coating liquid in the application zone and being biased under pressure substantially uniformly across the web against a substantially uniform, quiescent and stable layer of coating liquid of minimal excess wet film thickness for leveling and smoothing the coating liquid retained on the web to a uniform final wet film thickness, an improved surface smoothness substantially free of cross direction caliper variations, and an appearance free of machine direction streakiness.

2. A method as set forth in claim 1, including the step of doctoring the coating liquid on the web at the rear edge of the application zone to a wet film thickness that exceeds the final wet film thickness by from about 0.001 to about 0.004 inch.

3. A method as set forth in claim 1, including the step of doctoring the coating liquid on the web at the rear edge of the application zone to doctor onto the web an amount of excess coating to be removed from the web in the final doctoring step at a rate of from about 0.25 to about 0.75 gallons per minute per inch of web width.

4. A method as set forth in claim 1, including the steps of doctoring onto the web at the rear edge of the application zone a layer of coating that is the equivalent of a bone dry coat weight of from about 25 to about 85 bone dry pounds per 3300 square foot ream, and subsequently doctoring the layer of coating liquid on the web to a layer of coating that is the equivalent of a bone dry coat weight of from about 5 to about 15 bone dry pounds per 3300 square foot ream.

5. A method as set forth in claim 1, wherein the coating doctored to the web at the rear edge of the application zone is from about 2 to about 10 times the amount of coating retained on the web after final doctoring.

6. A method as set forth in claim 1, wherein the doctoring at the rear edge of the application zone is performed at a primary doctor blade doctoring pressure in the order of from about 1 to about 4½ pounds per lineal inch of web width, and the final doctoring is performed at a final doctor blade doctoring pressure in the order of from about 2 to about 9 pounds per lineal inch of web width.

7. A method as set forth in claim 1, including the step of performing the final doctoring within about 4 to about 24 inches of web travel following doctoring at the rear edge of the application zone.

8. A method as set forth in claim 1, including the step of applying coating liquid to the web upstream from the front edge of the application zone immediately prior to distributing coating liquid over the web in the application zone.

9. A method as set forth in claim 1, including the steps of applying coating liquid to the web upstream from the front edge of the application zone and subjecting the coating liquid to a zone of shear substantially immediately prior to distributing coating liquid over the web in the application zone.

10. A method of rectifying the problems of an appearance of machine direction streakiness and reduced surface smoothness due to cross direction caliper variations in a coating applied to a moving web of paper by short dwell time application means when operated at web speeds of 3,000 and more feet per minute, wherein the method includes the steps of moving the web in a given direction at a speed of at least 3,000 feet per minute, supporting the moving web through a portion of its path of movement, forming on the supported portion of the web a short dwell coating liquid application zone having a limited dimension in the direction of web movement and having rear and side edges effectively engageable with the supported web and a front edge spaced from the supported web and defining a gap between itself and the web at the upstream front edge of the application zone, forming and maintaining a reservoir of coating liquid under pressure and in a turbulent state on the supported web within the application zone by substantially sealing the side edges of the application zone to the web and forming a liquid seal between the liquid in the application zone and the surface of the web in the vicinity of the gap between the web and the front edge of the zone, continuously flowing an excess of coating liquid under a pressure of from about 7 to about 100 inches of water into and through the application zone and outwardly through the gap at the front edge of the zone reversely of the direction of web movement for maintaining the reservoir of liquid in the zone under pressure, for continuously purging the application zone, for forming and maintaining the liquid seal, and for excluding air and foreign matter from the coating liquid adjacent the rear edge of the zone, distributing coating liquid in a turbulent state and under said pressure over the surface of the supported web through the limited application zone, subjecting the coating liquid on the supported web to a primary doctoring immediately at the rear edge of the application zone, while the coating liquid is maintained under pressure and within about 0.0004 to about 0.0100 second of its pressure application to the web within the zone, by means of a primary doctor blade biased under a relatively low doctoring pressure against the coated web to form on the traveling web a generally uniform and relatively quiescent layer of coating liquid having a wet film thickness that exceeds the amount of coating required for the final wet film thickness by an amount in the order of from about 0.25 to about 0.75 gallons per minute per inch of web width, and at a location spaced downstream from the rear edge of the application zone and physically and hydrodynamically isolated from the turbulent coating liquid in the application zone, but within about 0.003 to about 0.040 second following the primary doctoring step, subjecting the generally uniform and relatively quiescent layer of coating liquid on the supported web to a final doctoring by means of a final doctoring blade biased under final doctoring pressure against the coated web to remove the excess coating from the web and to level and smooth the coating retained on the web to final wet film thickness and smoothness, the wet film thickness of the generally uniform and quiescent layer of coating liquid formed on the web by the primary doctor blade having a lower limit sufficiently in excess of the final wet film thickness to provide at the final doctor blade an excess amount of coating liquid adequate to cause a substantially continuous run-off of excess coating liquid from the final blade to purge and flush the final doctor blade, and having an upper limit preventing hydrodynamic overloading of the final doctor blade and minimizing the work required of the final doctor blade, the dwell time of the coating liquid on the web between the primary and final doctor blades enabling the boundary layer of coating liquid next to the web to become substantially immobilized for supporting the final doctor blade, whereby the final leveling and smoothing of the coating takes place where the coating is substantially stable, the final doctor blade being isolated from the turbulence of the coating liquid in the application zone and being biased under pressure substantially uniformly across the web against a substantially uniform, quiescent and stable layer of coating liquid of minimal excess wet film thickness for leveling and smoothing the coating liquid retained on the web to a uniform final wet film thickness, an improved surface smoothness substantially free of cross direction caliper variations, and an appearance free of machine direction streakiness.

11. A method as set forth in claim 10, including the steps of establishing a gap of about ⅛ to ⅜ inch between the web and the front edge of said application zone, and continuously flowing coating liquid under pressure reversely of the direction of web travel through the gap in an amount of from about 0.75 to about 2 gallons per minute per inch of web width for forming said liquid seal, for excluding air and foreign matter from the vicinity of the primary doctor blade, and for continuously purging the application zone.

12. A method as set forth in claim 10, including the steps of biasing the primary doctor blade against the coated web at a blade pressure of from about 1 to about 4½ pounds per lineal inch of blade width, and biasing the final doctor blade against the coated web at a blade pressure of from about 2 to about 9 pounds per lineal inch of blade width.

13. A method as set forth in claim 10, including the step of applying an initial coating to the web upstream from the front edge of the application zone substantially immediately prior to applying coating liquid to the web in the application zone.

14. A method as set forth in claim 10, including the steps of applying an initial coating to the web upstream from the front edge of the application zone and subjecting the initial coating to a zone of shear substantially immediately prior to applying coating liquid to the web in the application zone.

15. Apparatus for applying a coating essentially free of machine direction streakiness and cross direction caliper variations to a web of paper by short dwell time type applicator means when operated at a web speed of 3,000 and more feet per minute, comprising means for moving the web in a given direction at a speed of at least 3,000 feet per minute.

means for supporting the moving web, means forming a coating liquid receiving chamber extending substantially across and parallel to the supported web, said chamber defining a narrow, short dwell application zone having front, rear and side edges and facing toward and extending across the supported web, the front edge of said application zone being spaced from the supported web and defining a gap between itself and the web at the upstream front edge of said zone, a first doctor blade located at the rear edge of said application zone, means for delivering coating liquid to said chamber and into said application zone for distribution over the supported web, said means delivering coating liquid into and through said gap for forming a liquid seal between the coating liquid and the web within said zone in the vicinity of the front edge thereof for excluding air an foreign matter from said first doctor blade, said means delivering an excess of coating liquid to said chamber for continuously purging said application zone and said first doctor blade, means for biasing said first doctor blade against the coated supported web at a relatively low doctoring pressure to doctor to the web a generally uniform and relatively quiescent layer of coating liquid sufficiently thicker than the wet film thickness of the coating ultimately to be retained on the web to accommodate a subsequent wet film blading of such thicker layer, said first doctor blade being spaced from about ¾ to about 3 inches downstream from the front edge of said zone for doctoring the coating liquid on the web within about 0.0004 to about 0.0100 seconds following distribution of the coating liquid over the web within said zone, a second doctor blade spaced from about 4 to about 24 inches downstream from the first named doctor blade for engagement with the coated supported web at a location that is physically and hydrodynamically isolated from said application zone, the spacing between said first and second doctor blades providing a dwell time of from about 0.003 to about 0.040 second of the quiescent layer of coating liquid on the web for enabling the boundary layer of coating next to the web to become substantially stabilized on the web, and means for biasing said second doctor blade against the generally uniform, stable and quiescent layer of coating liquid on the supported web at a finishing doctoring pressure for removing excess coating liquid from the web and leveling and smoothing the retained coating to a uniform final wet film thickness, an improved surface smoothness substantially free of cross direction caliper variations, and an appearance free of machine direction streakiness.

16. Apparatus for applying a coating essentially free of machine direction streakiness and cross direction caliper variations to a web of paper by short dwell time type applicator means when operated at a web speed of 3,000 and more feet per minute, comprising means for moving the web in a given direction at a speed of at least 3,000 feet per minute, means for supporting the moving web, means forming a coating liquid receiving chamber extending substantially across and parallel to the supported web, said chamber defining a narrow, short dwell application zone having front, rear and side edges and facing toward and extending across the supported web, the front edge of said application zone being spaced from the supported web and defining a gap between itself and the web at the upstream front edge of said zone, a first doctor blade located at the rear edge of said application zone, means for delivering coating liquid to said chamber and into said application zone for distribution over the supported web, said means delivering coating liquid into and through said gap for forming a liquid seal between the coating liquid and the web in the vicinity of the front edge of said zone for excluding air and foreign matter from said first doctor blade, said means delivering an excess of coating liquid to said chamber for continuously purging said application zone and said first doctor blade, means for biasing said first doctor blade against the coated supported web at a relatively low doctoring pressure to doctor to the web a generally uniform and relatively quiescent layer of coating liquid sufficiently thicker than the wet film thickness of the coating ultimately to be retained on the web to accommodate a subsequent wet film blading of such thicker layer, said first doctor blade being spaced no more than about 4 inches downstream from the front edge of said zone for doctoring the coating liquid on the web within no more than about 0.0100 seconds following distribution of the coating liquid over the web within said zone, a second doctor blade spaced no more than about 24 inches downstream from the first named doctor blade for engagement with the coated supported web at a location that is physically and hydrodynamically isolated from said application zone, the spacing between said first and second doctor blades providing a dwell time of no more than about 0.040 second of the quiescent layer of coating liquid on the web for enabling the boundary layer of coating next to the web to become substantially stabilized on the web, and means for biasing said second doctor blade against the generally uniform, stable and quiescent layer of coating liquid on the supported web at a finishing doctoring pressure for removing excess coating liquid from the web and leveling and smoothing the retained coating to a uniform final wet film thickness, an improved surface smoothness substantially free of cross direction caliper variations, and an appearance free of machine direction streakiness.

17. Apparatus as set forth in claim 16, wherein said first blade is spaced from about ½ to about 1½ inches downstream from the front edge of said zone.

18. Apparatus as set forth in claim 16, wherein the first biasing means applies a doctoring pressure on said first blade in the order of about 1 to about 4½ pounds per lineal inch of web width and causes said blade to doctor onto the web a layer of coating that is about 0.0010 to about 0.0040 of an inch thicker than the wet film thickness of the coating ultimately to be retained on the web.

19. Apparatus as set forth in claim 16, wherein the second biasing means applies a doctoring pressure on said second blade in the order of about 2 to about 9 pounds per lineal inch of web width and causes said second blade to doctor onto the web a layer of coating providing a final bone dry coat weight in the order of from about 5 to about 15 pounds per 3,300 square foot ream.

20. Apparatus as set forth in claim 18, wherein the second biasing means applies a doctoring pressure on said second blade in the order of about 2 to about 9 pounds per lineal inch of web width and causes said second blade to doctor onto the web a layer of coating providing a final bone dry coat weight in the order of from about 5 to about 15 pounds per 3,300 square foot ream.

21. Apparatus as set forth in claim 16, including an applicator engaging the supported web substantially immediately upstream but spaced from the front edge of said chamber for applying coating liquid to the web substantially immediately prior to the distribution of coating liquid over the web within the said application zone.

22. Apparatus as set forth in claim 21, including means defining a coating liquid shear zone between said applicator and said application zone for subjecting the coating applied to the web by said applicator to shear immediately prior to the distribution of coating liquid over the web within said application zone.

23. Apparatus as set forth in claim 16, wherein said means for supporting the moving web comprises a backing roll having ah upwardly moving outgoing side including a lower quadrant of the roll surface, the web is supported on at least said upwardly moving lower quadrant of the roll surface during its passage about the roll, and said apparatus engages the roll supported web within said quadrant.

24. Apparatus as set forth in claim 23, wherein said second blade engages the roll supported web in the vicinity of the horizontal center line of the roll and said application zone and said first blade engage the roll supported web within said quadrant below said second blade.

25. Apparatus as set forth in claim 24, including a preliminary coating liquid applicator engaging the roll supported web in proximity to the lower end of said quadrant below said application zone.

26. Apparatus as set forth in claim 25, wherein said preliminary applicator is a dip roll applicator having a dip roll engageable with the roll supported web proximate to the bottom dead center position of said roll.

27. Apparatus as set forth in claim 25, wherein said preliminary applicator comprises means forming a coating liquid receiving chamber extending substantially across and parallel to the supported web, said chamber defining a narrow coating liquid outlet slot having front, rear, and side edges facing toward and extending across the supported web, and means for delivering coating liquid under pressure to said chamber and through said outlet slot for pressurized application onto the web.

28. Apparatus as set forth in claim 27, including a doctor blade located at the rear edge of said outlet slot for doctoring coating liquid applied to the supported web while the coating liquid is held under pressure.

29. Apparatus as set forth in claim 25, including means defining a coating liquid shear zone on the roll supported coated web intermediate said preliminary applicator and said application zone for subjecting the coating liquid on the web to shear prior to distribution of the coating liquid over the web within said application zone.

30. Apparatus for coating a high speed moving web of paper comprising a backing roll for supporting the moving web, a short dwell time coating device having a limited application zone facing the roll supported web and extending transversely across the web parallel thereto, said zone having front, rear and side edges, a first doctor blade carried by said device at the rear edge of said zone, first mounting means mounting said device and said first doctor blade for movement toward and away from the roll supported web, second mounting means pivotally mounting said first doctor blade on said first mounting means for pivotal movement about an axis substantially coincident with the tip of said first doctor blade, a second doctor blade spaced downstream from said first doctor blade in the direction of web travel, third mounting means movably mounting said second doctor blade on said first mounting means for movement with said first mounting means and for independent movement relative to said first mounting means, and fourth mounting means pivotally mounting said second doctor blade on said third mounting means for pivotal movement about an axis substantially coincident with the tip of said second doctor blade, said first and third mounting means mounting said device and said first and second doctor blades for conjoint movement toward and away from the roll supported web, said third mounting means mounting said second doctor blade for separate movement toward and away from the web, said second and fourth mounting means respectively mounting said first doctor blade and said second doctor blade for respective independent adjustment of the angles of the first and second blades relative to the web.

31. Apparatus as set forth in claim 30, including independent actuator means for each of said mounting means for effecting independent adjustment of each of said device and said first and second doctor blades relative to the roll supported web.

* * * * *